US005109794A

United States Patent [19]

Komatsu et al.

[11] Patent Number: 5,109,794

[45] Date of Patent: May 5, 1992

[54] PUMP DEVICE FOR ELECTROSTATIC PLOTTER

[75] Inventors: Fumito Komatsu; Tositatsu Kawatsu, both of Ina, Japan

[73] Assignee: Nippon Steel Corporation, Tokyo, Japan

[21] Appl. No.: 765,423

[22] Filed: Sep. 25, 1991

[30] Foreign Application Priority Data

Sep. 27, 1990 [JP] Japan ..... 2-257981

[51] Int. Cl.[5] ..... G03G 15/10

[52] U.S. Cl. ..... 118/660; 346/153.1; 355/256

[58] Field of Search ..... 118/660, 359; 355/245, 355/256, 326, 327, 247; 346/157, 153.1

[56] References Cited

U.S. PATENT DOCUMENTS 3,927,409 12/1975 Kase et al. ..... 346/153.1
4,117,778 10/1978 Watanabe et al. ..... 346/153.1 X
4,198,923 4/1980 Blumenthal ..... 118/660
4,290,076 9/1981 McFarland ..... 346/153.1 X
4,613,226 9/1986 Kimura et al. ..... 118/660 X
4,622,915 11/1986 Ohtsuka et al. ..... 355/256
4,793,281 12/1988 Dobbins et al. ..... 118/660 X
4,851,317 7/1989 Chuang et al. ..... 430/119
4,965,597 10/1990 Ohigashi et al. ..... 355/327 X
5,043,756 8/1991 Takabayashi et al. ..... 354/320

*Primary Examiner*—A. T. Grimley
*Assistant Examiner*—Sandra L. Brasé
*Attorney, Agent, or Firm*—Pollock, Vande Sande & Priddy

[57] ABSTRACT

A pump device for an electrostatic plotter discharges through a discharge passage a liquid toner drawn from a first suction passage to supply the liquid toner to a liquid toner supplier unit of the plotter. A restriction is provided to adjust the flow of the liquid toner through the first suction passage. A second suction passage joins the first suction passage downstream of the restriction. Negative pressure is generated in the first suction passage downstream of the restriction to suck the liquid toner from a suction port unit of the plotter through the second suction passage.

5 Claims, 4 Drawing Sheets

PUMP DEVICE FOR ELECTROSTATIC PLOTTER

BACKGROUND OF THE INVENTION

1. Field of the Invention

The present invention relates to a pump device for supplying liquid toner to an electrostatic plotter which uses liquid toner to develop electrostatic latent images on paper sheets.

2. Description of the Prior Art

In the prior art, the duct for conveying liquid toner from a pump to a liquid-toner supplier unit is branched into two ducts, one of which is provided with an aspirator. A part of the liquid toner supplied by the pump is discharged through the aspirator. The flow of the liquid-toner through the aspirator generates negative pressure therein. The excess of the liquid toner supplied onto a printing paper sheet is sucked through a suction port unit into the aspirator by the negative pressure. The sucked toner is discharged together with the liquid toner which is flowing from the pump through the aspirator.

Since the aspirator must be supplied with a flow of liquid toner, as described above, the pump has to force out more liquid toner than actually required for printing; in some cases, the amount exceeds two times the actual requirement. Therefore, a large pump is required, which takes up a large space for installation and thus is economically disadvantageous.

Also, since there are limits in respect of the installation space or costs, a pump or an aspirator of sufficient size or capacity can not always be employed. An aspirator of insufficient capacity may fail to suck the excess liquid toner (not-adhered toner) present in creases or wrinkles on paper sheets even if they are small, so that the paper sheets may be stained and the images may be blurred.

SUMMARY OF THE INVENTION

The object of the present invention is to provide a pump device for an electrostatic plotter, which is able not only to supply liquid toner to develop images on paper sheets but also to such excess liquid toner from the paper.

The present invention provides a pump device for an electrostatic plotter, comprising:

a housing;

a pump accommodated by said housing;

a first suction passage provided in the housing to connect the pump to a liquid toner source;

adjusting means for adjusting the flow of the liquid toner through the first suction passage;

a second suction passage provided in the housing and having a downstream end connected to the first suction passage downstream of the adjusting means and an upstream end adapted to be connected to a suction port unit of the electrostatic plotter; and a discharge passage connected to a downstream side of the pump inside the housing to discharge the liquid toner drawn from the first and second suction passages towards a liquid toner supplier of the electrostatic plotter.

In the pump device of the invention designed as above, the adjusting means is operative to adjust the flow of the liquid toner through the first suction passage so that the negative pressure is generated in the second suction passage to a vacuum level sufficient to suck excess liquid toner from paper sheets into the second suction passage. Thus, unlike the prior art, the present invention does not require any aspirator which requires a substantial flow of liquid toner. Accordingly, the flow of the liquid toner through the pump device can be reduced so as to facilitate reduction in the size of the pump device. Also, stains or blurs on prints can be reduced.

The above and other objects, features and advantages of the present invention will become more apparent from the following description.

DESCRIPTION OF THE PREFERRED EMBODIMENT

Figure 3:
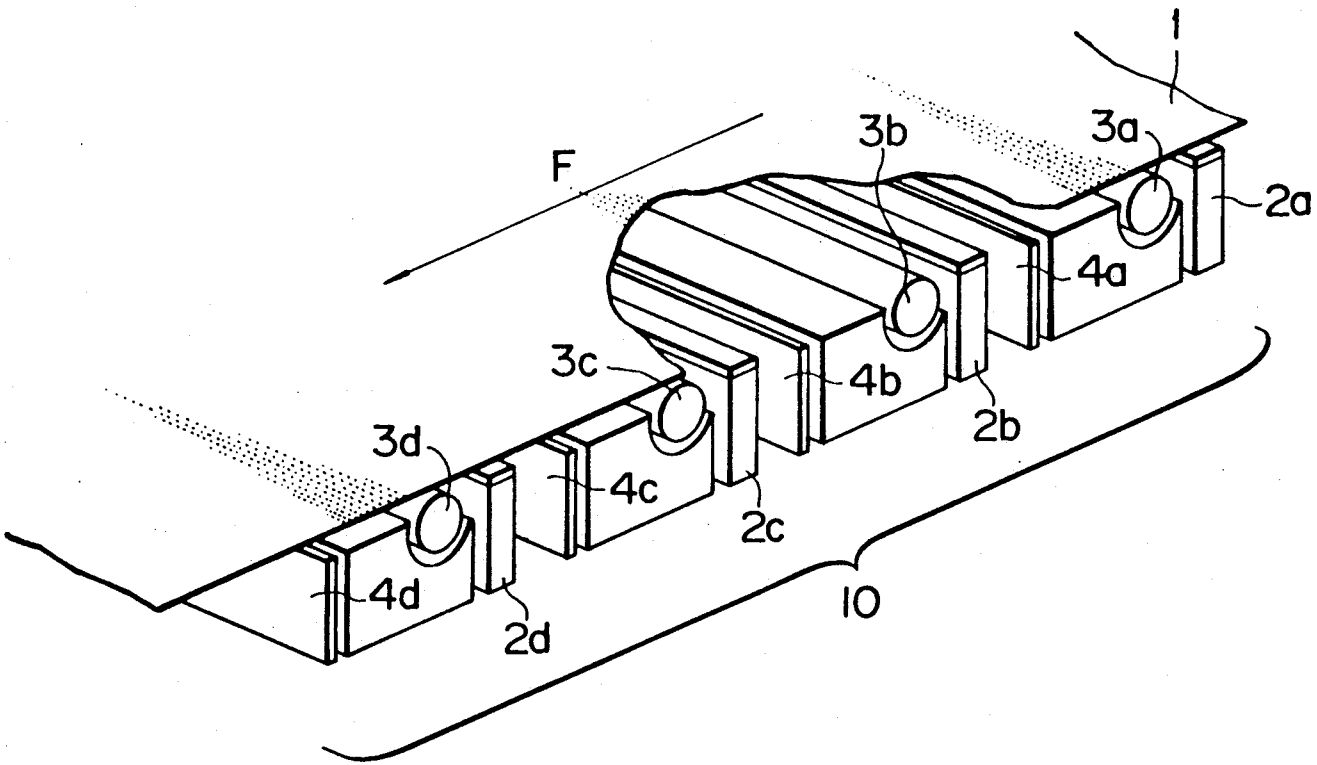
FIG. 3 illustrates the principle of electrostatic printing in an electrostatic plotter.

With reference to FIG. 3, the principle of electrostatic printing in an electrostatic plotter will be described. A sheet of paper 1 is fed in a direction indicated by an arrow F. Under the paper 1, there is provided a printing section 10 consisting of four similar assemblies for black, cyan, magenta and yellow liquid toners. Each assembly comprises a recording head 2*a*, 2*b*, 2*c* or 2*d* which includes multiple electrodes and extends transversely of the paper sheet 1; a liquid toner supplier unit 3*a*, 3*o*, 3*c* or 3*d* which is disposed immediately downstream of the head; and a suction port unit 4*a*, 4*b*, 4*c* or 4*d* which is placed just downstream of the toner supplier unit. When the paper sheet 1 goes over the printing section 10, each of the recording heads forms electrostatic latent images on the paper 1 and, then, the downstream liquid toner supplier unit sprays the liquid toner onto the paper sheet 1. A part of the sprayed liquid toner adheres to the electrostatic latent images. Then, at a point downstream of the supplier unit, the rest of the sprayed liquid-toner is sucked into the suction port 4. Such steps are carried out for black, cyan, magenta and yellow to print color images on the paper sheet 1.

Figure 1:
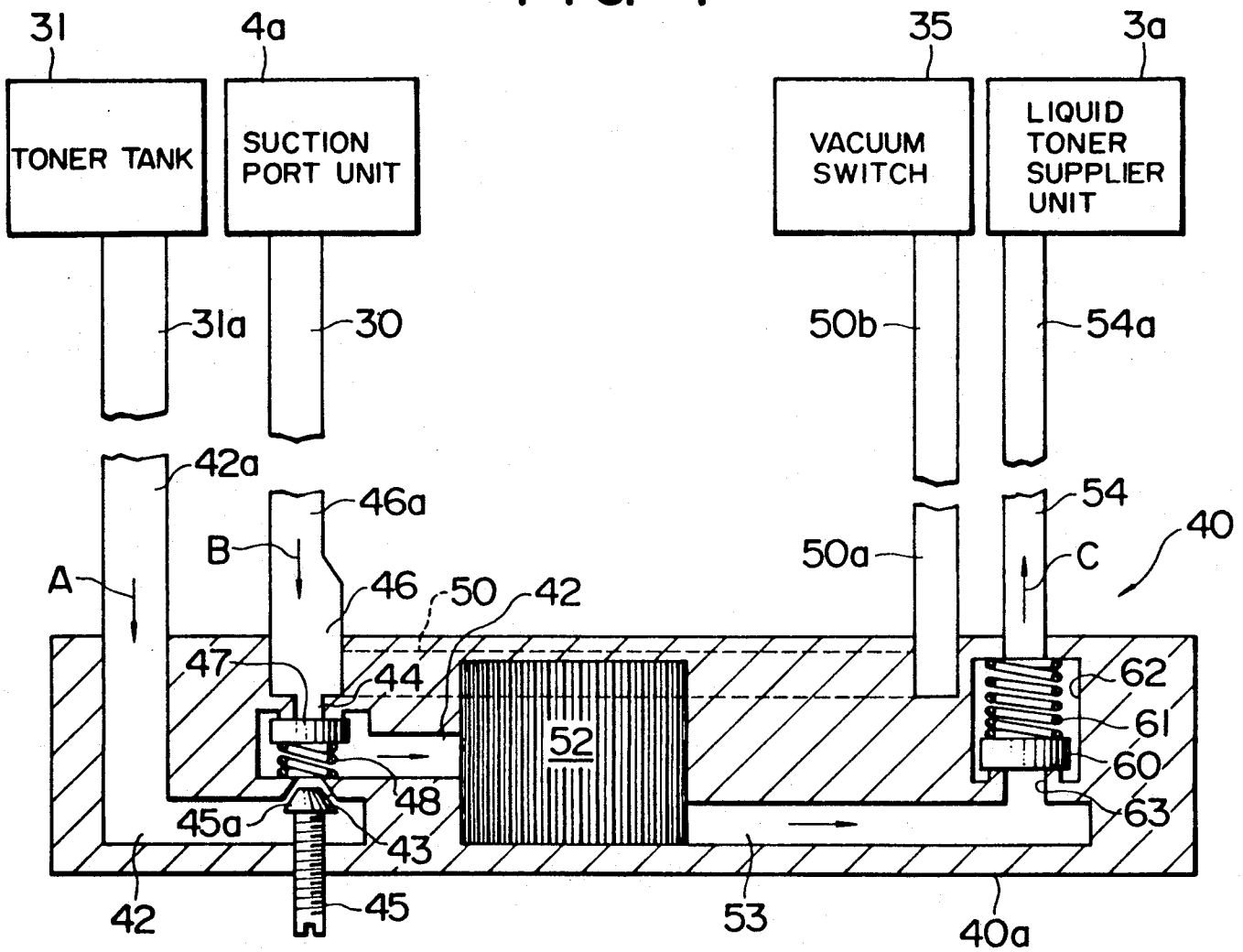
FIG. 1 is a schematic sectional view of a pump device for an electrostatic plotter according to an embodiment of the present invention.

As shown in FIG. 1, a pump device 40 for the electrostatic plotter according to one embodiment of the present invention comprises a housing 40*a* and a gear pump 52 disposed in the housing 40*a*.

The housing 40*a* includes a first suction passage 42 through which liquid toner is supplied to the gear pump 52. The first suction passage 42 is connected through a first joint 42*a* to a duct 31*a* which is connected to a toner tank 31. The first suction passage 42 has a truncated restriction 43. An adjusting means comprising a screw 45 having a conical head portion 45*a* is provided on the housing 40*a*. The restriction 43 can be adjusted by rotating the screw 45, i.e., setting the head portion 45*a* closer to or away from the restriction 43. At a point downstream of the restriction 43, the first suction passage 42 is connected to a second suction passage through a confluence opening 44. The second suction passage 46 is connected through a second joint 46*a* to a duct 30 which is connected to the suction-port unit 4*a* of the printing section 10. Such pump device 40 must be provided for each of the black, cyan, magenta and yellow liquid toners. The embodiment shown in FIG. 1 is a pump device for black liquid toner, so that the second suction passage 46 thereof is connected to the suction port unit 4*a*. The confluence opening 44 is provided with a check valve 47 to prevent the liquid toner in the first suction passage 42 from flowing to the second suction passage 46. The check valve 42 is urged by a coil spring 48 to close the confluence opening 44. At a point upstream of the confluence opening 44, the second suction passage 46 is also connected to a third passage 50. The passage 50 is connected through a third joint 50*a* to a duct 50*b* which is connected to a vacuum switch 35 which monitors the negative pressure in the second suction passage 46. The gear pump 52 is connected at its outlet side to a discharge passage 53 connected through a valve opening 63 to a valve chamber 62. The valve chamber 62 is provided with a coil spring 61 which urges a check valve 60 to close the valve opening 63. The valve chamber 62 is connected by a fourth joint 54 to a duct 54*a* which is connected to the liquid toner supplier unit 3*a* of the printing section 10.

Figure 2B:
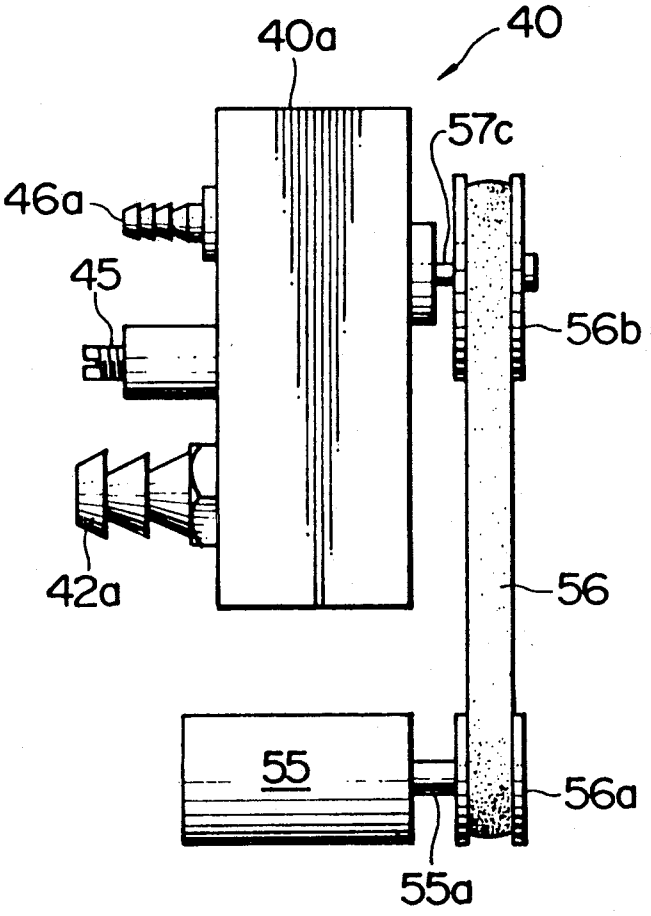
FIGS. 2A and 2B are front and left-hand-side elevations, respectively, of the pump device shown in FIG. 1.

FIG. 1 is a schematic sectional view of the pump device, showing the principle thereof, and the positions or arrangement of the parts such as the joints are simplified or modified. The precise positions or arrangements thereof are shown in FIGS. 2A and 2B.

Figure 2A:
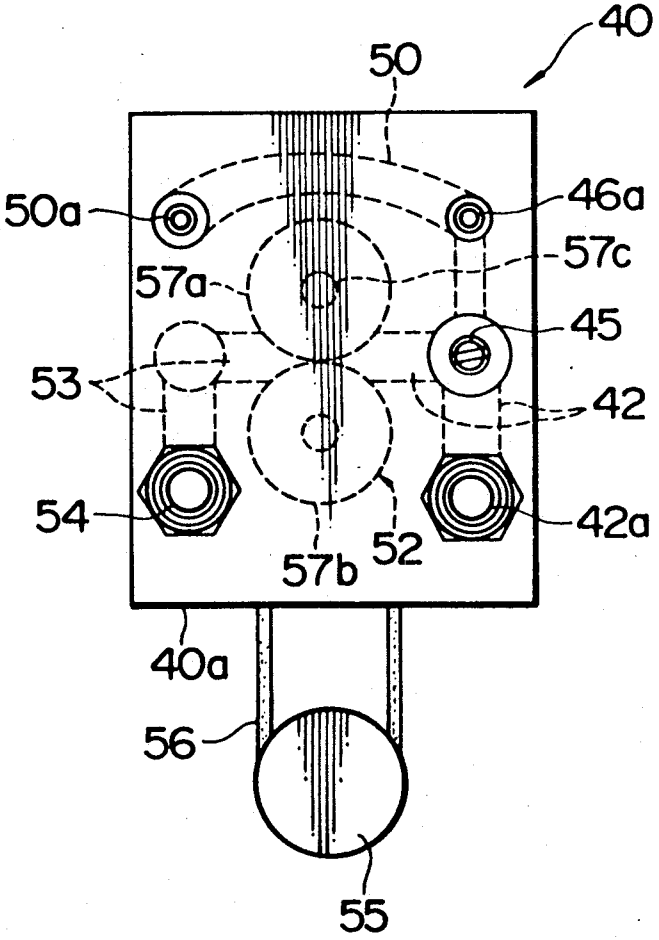

As shown in FIG. 2A, the gear pump 52 comprises a pair of gears 57*a* and 57*b* disposed in meshing engagement with each other. A shaft 57*c* of the gear 57*a* extends out of the housing 40*a* and has a pulley 56*b* on the outside extension thereof, as shown in FIG. 2B. A pulley 56*a* is mounted on a drive shaft 55*a* of the motor 55 and drivingly connected to the pulley 56*b* by a belt 56. When the gear 57*a* is driven clockwise (as viewed in FIG. 2A) by the motor 55, the gear 57*b* rotates counterclockwise.

In the embodiment described above, the check valve 47 is provided in order to prevent the liquid toner in the first suction passage 42 from flowing into the second suction passage 46. However, the check valve 47 may be omitted depending on the positioning of the pump device 40 and toner tank 31 or other parts, for instance, when the pump device 40 is disposed at a level higher than the toner tank 31.

The gear pump 52 is not essential for the present invention. Alternatively, a rotary or reciprocating pump may be used.

While the passage 50 is formed in the housing 40*a* of the pump device 40 in this embodiment, the passage may be provided outside the housing 40*a*.

Obviously, the described embodiment of the invention is designed for a multi-color electrostatic plotter but can also be employed for a black-and-white electrostatic plotter.

The operation of this embodiment will be explained hereunder. When the motor 55 is rotated, the pair of the gears 57*a* and 57*b* are rotated in meshing engagement with each other so that the liquid toner is sucked from the toner tank 31 through the first suction passage 42 in the direction indicated by an arrow A. Then, the liquid toner is introduced into the gear pump 52 through the restriction 43 which is adjusted by the adjusting means comprising the screw 45 having the head portion 45*a*. Negative pressure is generated in the first suction passage 42 downstream of the restriction 43. By this negative pressure, the surplus sprayed liquid toner which is excessively supplied onto the paper sheet is sucked together with air into the suction port unit 4*a* and then drawn through the second suction passage 46 in the direction indicated by an arrow B into the first suction passage 42 through the confluence opening 44. The liquid toner flowing into the first suction passage 42 is pumped by the engaged rotations of the gears 57*a* and 57*b* into the discharge passage 53 downstream of the pump 52 and flows through the check valve 60 and through the fourth joint 54 in the direction indicated by an arrow C to the liquid toner supplier unit 3*a* in the printing section 10 of the electrostatic plotter. The liquid toner is separated from air by means not shown in the drawings before the toner reaches the liquid toner supplier unit 3*a*.

The gear pump 52 pumps the liquid toner in a downstream direction at a substantially constant rate as long as the motor rotates at a constant speed. Therefore, the level of the negative pressure acting to the suction port unit 4*a* from the pump 52 can be adjusted by rotating the screw 45 to adjust the opening of the restriction 43. Consequently, by employing the pump device 40 according to this embodiment, the amount of the liquid toner required for the liquid toner supplier unit 3*a* can be substantially reduced compared with that in the prior art. Thus, the pump device 40 is of a reduced size, affording more liberty in designing. Also, since the suction capacity of the suction port can be sufficiently improved to substantially avoid stains or blurs even if the paper sheets have some creases or wrinkles.

Also, the vacuum switch 35 monitors the level of the negative pressure in the second suction passage to assure that the suction port is performing its intended toner-sucking action.

Figure 4:
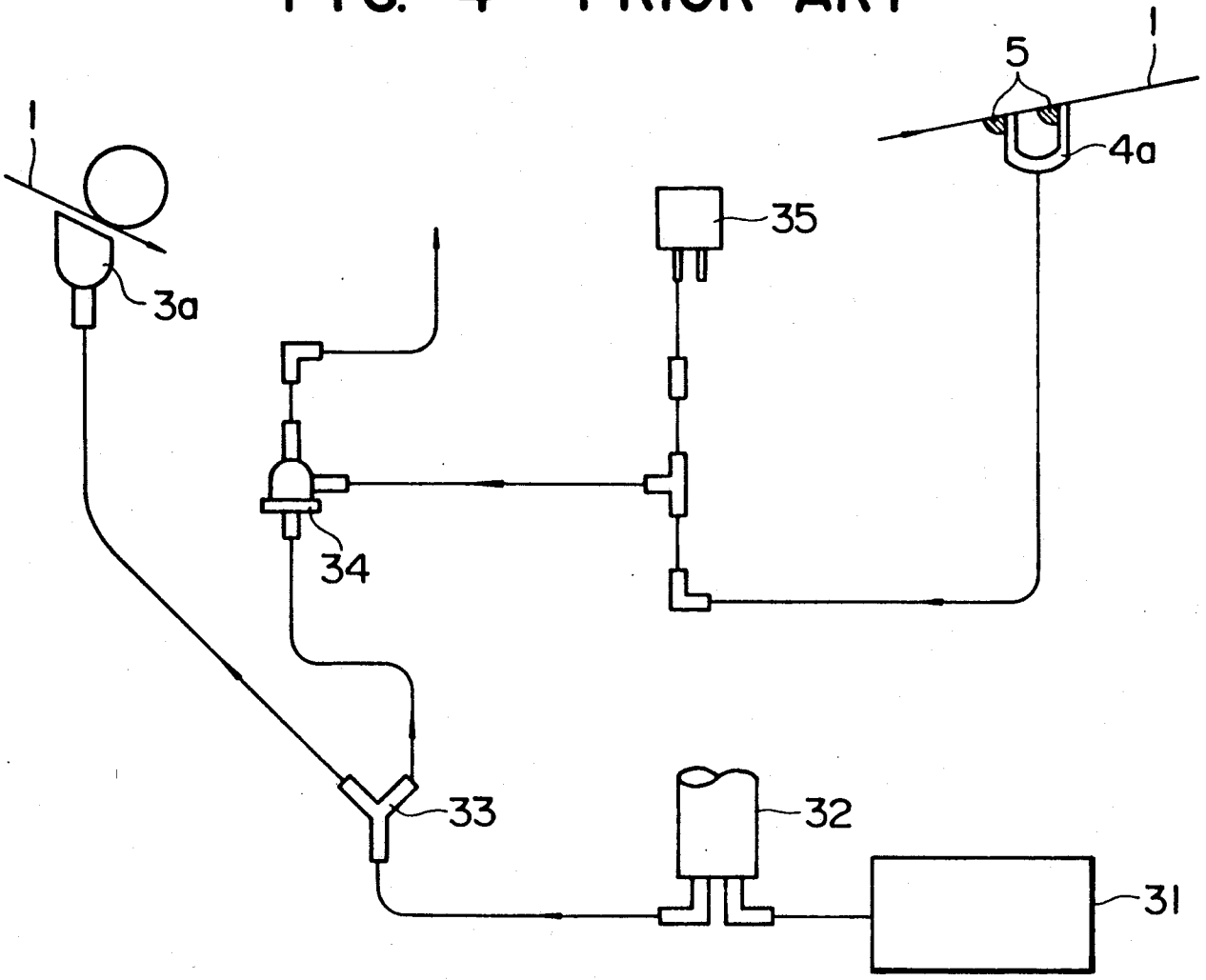
FIG. 4 PRIOR ART
FIG. 4 shows an example of a conventional duct system in an electrostatic plotter for supplying liquid toner to a liquid toner supplier unit and for collecting excess liquid toner from paper sheets by vacuum.

The prior art shown in FIG. 4 will be described hereinafter. The ducting system shown in FIG. 4 is only for one (black herein) of the black, cyan, magenta and yellow toners. The above electrostatic plotter comprises four such ducting systems.

The liquid toner is sucked by a pump 32 from a toner tank 31 to a Y-shaped joint 33 where a part of the liquid toner is delivered to a liquid toner supplier unit 3*a* which sprays the toner onto printing paper sheet 1, and the rest of the liquid toner is discharged through an aspirator 34. The discharged liquid-toner is separated from air mixed therein and then is collected into the toner tank 31. When the liquid toner flows through the aspirator 34, negative pressure is generated therein, whereby the excess liquid toner 5 sprayed onto the paper sheet is sucked into the suction port 4*a*. The sucked liquid toner is discharged together with the liquid toner flowing from the pump 32 through the aspirator 34. A vacuum switch 35 is provided on the duct extending from the suction port 4*a* to the aspirator 34. The vacuum switch 35 monitors the level of negative pressure to assure that, when the vacuum level is too low for the suction port unit 4*a* to perform sufficient suction due, for example, to creases or wrinkles on a paper sheet 1, the vacuum switch 35 stops feed of the sheet 1 to prevent excess liquid toner from being left on the paper sheet due to the insufficient suction of the suction port unit 4*a*.

What is claimed is:

1. A pump device for an electrostatic plotter, comprising:

a housing;

a pump accommodated by said housing;

a first suction passage provided in said housing to connect said pump to a liquid toner source;

adjusting means for adjusting the flow of said liquid toner through said first suction passage;

a second suction passage provided in said housing and having a downstream end connected to said first suction passage downstream of said adjusting means and an upstream end adapted to be connected to a suction port unit of the electrostatic plotter; and a discharge passage connected to a downstream side of said pump inside said housing to discharge the liquid toner drawn from said first and second suction passage towards a liquid toner supplier of the electrostatic plotter.

2. A pump device for an electrostatic plotter according to claim 1, wherein said second suction passage has a confluence opening where said second suction passage joins said first suction passage, and wherein a check valve is provided adjacent said confluence opening to prevent the liquid toner in said first suction passage from flowing into said second suction passage.

3. A pump device for an electrostatic plotter according to claim 2, further including:

a communication passage connected to said second suction passage upstream of said confluence opening; and a vacuum switch connected to said communication passage to monitor the level of negative pressure in said second suction passage.

4. A pump device for an electrostatic plotter according to claim 1, wherein said adjusting means includes a restriction provided in said first suction passage and an adjustable valve member having a head portion for varying an opening of said restriction.

5. A pump device for an electrostatic plotter according to claim 1, wherein said pump is a gear pump operative to pump the liquid toner at a substantially constant rate.

* * * * *